United States Patent [19]

Schmidt

[11] 4,166,647

[45] Sep. 4, 1979

[54] APPARATUS FOR POSITIONING HEAVY ROLLS AND THE LIKE

[76] Inventor: Adolf G. Schmidt, Münsterweg 24, Düren-Birgel, Fed. Rep. of Germany, D-5160

[21] Appl. No.: 785,535

[22] Filed: Apr. 7, 1977

[30] Foreign Application Priority Data

Oct. 27, 1976 [DE] Fed. Rep. of Germany ..... 2648665

[51] Int. Cl.[2] ..... B66C 1/34

[52] U.S. Cl. ..... 294/78 A

[58] Field of Search ..... 294/78 A, 86 LS, 93, 294/99, 65.5; 214/620, 8.5 A

[56] References Cited

U.S. PATENT DOCUMENTS

| | | | |
|---|---|---|---|
| 2,752,191 | 6/1956 | Pierce | 294/93 |
| 2,882,086 | 4/1959 | Steinback | 294/78 A |
| 2,913,276 | 11/1959 | Collings | 294/78 A |
| 2,999,716 | 9/1961 | Elberty | 294/86 LS |

FOREIGN PATENT DOCUMENTS

| | | | |
|---|---|---|---|
| 887501 | 12/1971 | Canada | 294/78 A |

*Primary Examiner*—James B. Marbert
*Attorney, Agent, or Firm*—Victor E. Libert

[57] ABSTRACT

Apparatus for the positioning of heavy objects, particularly rolls of paper or other weblike materials, comprises a clamping device for the object to be positioned, e.g., turned over, as well as a swivel mechanism, in which arrangement the clamping device is firmly connected with a circularly bent roll bracket which is movably guided in an appropriately constructed curved guidance of the swivel mechanism and whose center of curvature lies in the common center of gravity of the object to be positioned and the moving parts of the swivel mechanism. For purposes of weight-unburdening of the empty apparatus, a traction drum is pivoted on a bolt in the tackle block, which drum is prestressed by a coil spring fastened on the bolt and on the inner wall of the traction drum, and also a traction rope which can be wound up on the traction drum is attached to a holding fixture of the clamping device.

16 Claims, 10 Drawing Figures

Fig.1
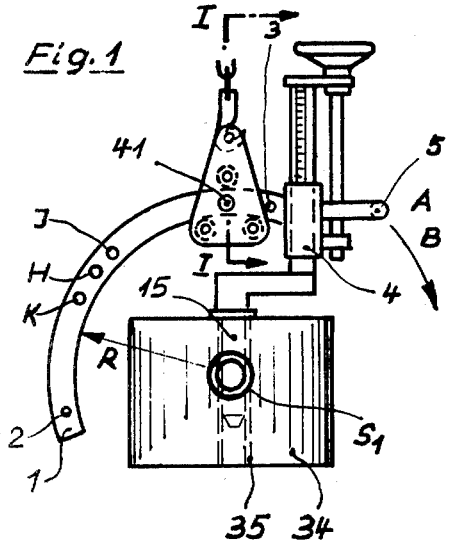
Fig.2
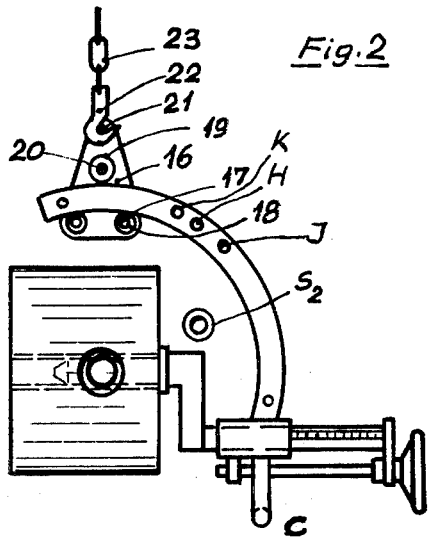
Fig.4
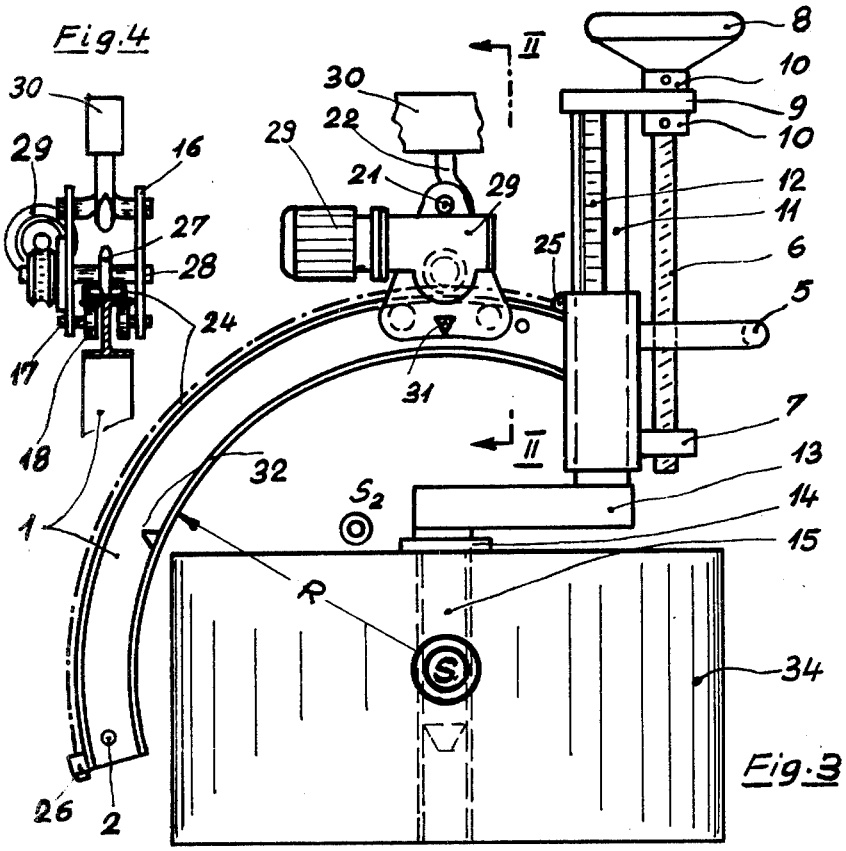
Fig.3

Fig. 7
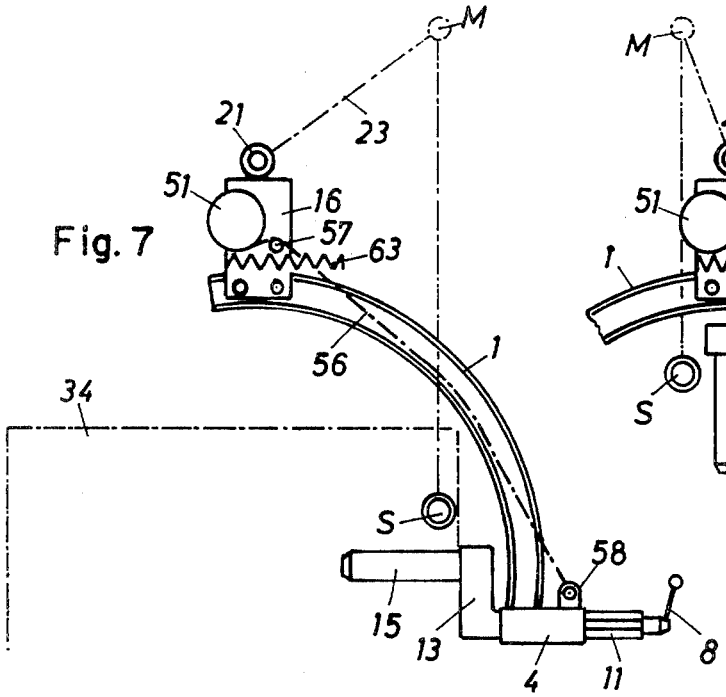
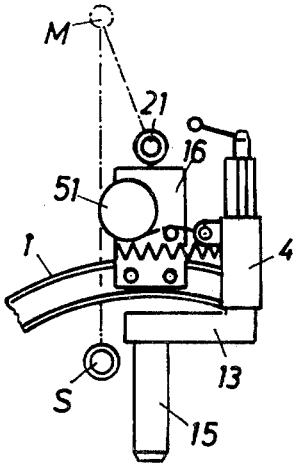
Fig. 8
Fig. 9
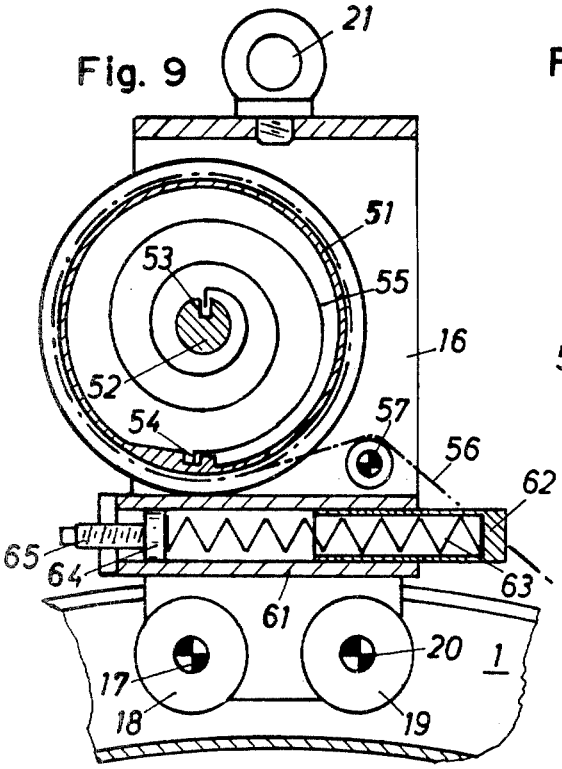
Fig. 10
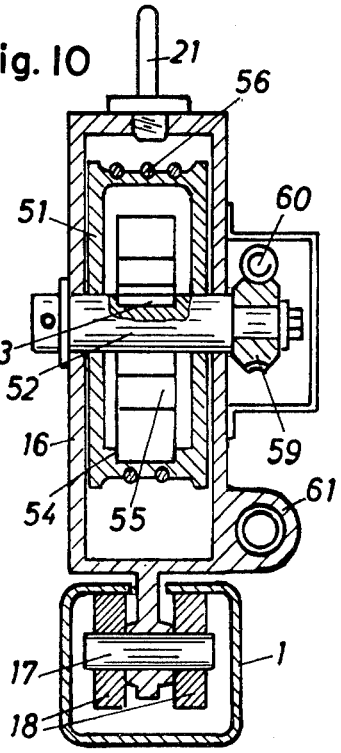

APPARATUS FOR POSITIONING HEAVY ROLLS AND THE LIKE

BACKGROUND OF THE INVENTION

The invention is concerned with an apparatus for the positioning of heavy objects, particularly rolls of paper or other weblike materials, comprising of a clamping fixture for the roll or other object to be positioned, eg, turned over, and a swivel mechanism. Such swivel devices are known for use as load-receiving appliances and as auxiliary equipment of cranes and forklift trucks. They have the task of moving the roll or other object from a position brought about by a prior processing or transporting step into a new processing or transporting position.

In the case of cylindrical bodies, like rolls of paper, plastic or metal, devices exist already which grip from the front side, whereas in the case of platelike objects the surface pointing upward is usually clamped. The swiveling of objects clamped in such a way takes place up to now around an axis which lies outside the one which goes through the common center of gravity of the object and the co-rotating part of the device. This has the disadvantage that the position of the common center of gravity is changed during the swinging operation. When the center of gravity travels downward, energy of the position has to be absorbed or converted respectively, whereas when the center of gravity travels upward, lifting energy is required. Such devices are therefore expensive not only as far as their construction is concerned, but their control mechanism together with the hoisting gear belonging to it is also relatively complicated. Beyond this, manipulating these devices, particularly those with internal clamping, requires skill in the releasing and clamping of the objects.

The invention is therefore based on the task of producing an apparatus in which, independent of the way in which the object is unilaterally gripped, the common center of gravity of the object and of the parts moving together with it in the swinging remains on the same level during the entire swinging operation.

SUMMARY OF THE INVENTION

This problem is solved according to the invention in the apparatus mentioned in the beginning in that the clamping device is firmly connected with a circularly bent roll bracket which is movably guided in an appropriately constructed curved guidance of the swivel mechanism and whose center of curvature lies in the common center of gravity of the object to be positioned and the parts of the swiveling mechanism moved together with it. This apparatus has, compared to the known swiveling devices, the great advantage that it can be swiveled without any effort by hand in the case of lighter objects with a weight of up to about 500 kg, so that otherwise necessary separately driven auxiliary devices can in these cases be dispensed with.

In order to be able to apply the invention also the objects with different dimensions or shapes respectively, it is in a further development of the invention suggested that the clamping device and the roll bracket be arranged movable and adjustable relative to each other in such a way that depending on the size or the shape of the object the common center of gravity can be brought in each case into the center of the roll-bracket arch. The range of application of the apparatus according to the invention is thereby not limited to the dimensions of only a single object but extends over a freely selectable range of sizes.

In appliances for the positioning of paper webs the clamping device is usually constructed as a receiving mandrel introducible into the rolling-up tube of the paper web. The swinging mechanism is in such an arrangement so constructed that the receiving mandrel is oriented approximately through the center of the roll-bracket arch and connected by means of a yoke with a sliding element concentric to the mandrel which is movably guided by means of a spindle drive or the like in a bushing fastened on the roll bracket.

In order to facilitate the vertical insertion and removal of the receiving mandrel another characteristic of the invention provides that a stop for the tackle block is set up on the wall bracket in such a way that the axis of the mandrel is vertical in the stop position. In order to facilitate also the horizontal introduction and withdrawal of the receiving mandrel, a second characteristic of the invention is likewise provided in that the tackle block is lockable on the roll bracket in a horizontal position of the receiving mandrel in the stop locations.

In order that in the case of heavy objects and in cases of frequently changing dimensions not exceedingly great demands have to be made on the accuracy in the trailing of the clamping device, the roll bracket can be constructed in the arched guidance of the swivel mechanism transportable by means of an auxiliary drive.

The invention thus provides an apparatus for the positioning of heavy objects, particularly rolls of paper or other weblike materials, which comprises a clamping device for the object to be positioned, e.g., turned over, as well as a swivel mechanism, in which arrangement the clamping device is firmly connected with a circularly bent roll bracket which is movably guided in an appropriately constructed curved guidance of the swivel mechanism and whose center of curvature lies in the common center of gravity of the object to be positioned and the moving parts of the swivel mechanism.

Such an apparatus is also suitable for the positioning and turning of heavy rolls in an arrangement in which manual operation is possible. Since the center of gravity of the roll bracket together with the roll coincides with the center of curvature of the roll bracket, also heavy loads can be moved by hand. A limitation exists only in the case of such devices for very heavy loads, since the empty apparatus can then under certain circumstances no longer be moved by hand because with the apparatus empty the center of gravity of the roll bracket with the empty clamping device does no longer coincide with the center of curvature of the roll bracket.

One embodiment of the invention aims at a device made in such a way that the empty apparatus is also adjustable by hand. This problem is solved according to the invention in that a spring-loaded traction drum is provided on the tackle block and is connected by a cable, rope, etc. to the clamping device for weight-unburdening the latter when it is empty. For example, a traction drum is pivoted on a bolt in the tackle block, which drum is prestressed by a coil spring fastened on the bolt and on the inner wall of the traction drum, and a traction rope which can be wound up on the traction drum is attached to a holding fixture of the clamping device.

By unburdening the weight of the empty clamping device the roll bracket can be moved by hand in any case, also if the center of gravity of the roll bracket together with the clamping device does not coincide with curvature center of the roll bracket. Thus can also heavy devices of the kind mentioned above be manually operated, whereby the range of application of such devices is considerably enlarged.

The invention provides in a further development an adjustment of the prestress of the drum by means of a setting device in order to make possible adaption of the tractive force of the traction rope to the specific weight of the clamping device.

The unburdening described above applies primarily to an orinetation of the clamping device with its axis horizontal. In order that the clamping device may also be unburdened with its axis in vertical orientation, the invention provides a stop slide prestressed by a compression spring. The apparatus becomes thus easily and securely movable in all operational positions.

BRIEF DESCRIPTION OF THE DRAWINGS

The invention shall be explained in detail with respect to certain embodiments thereof shown in the drawings in which:

FIG. 1 is an apparatus according to the invention with a vertically oriented mandrel in the receiving position;

FIG. 2 is the same apparatus after rotation, in the delivery position with the mandrel oriented horizontally;

FIG. 3 is the same apparatus with auxiliary drive in enlarged representation;

FIG. 4 a partial section through the roll bracket along the line II—II of FIG. 3;

FIG. 7 is a schematic general view of another enbodiment according to the invention in which the device includes a traction drum and is shown with the axis of the clamping device being oriented horizontally;

FIG. 8 is a corresponding partial view of FIG. 7 enbodiment with the axis of the clamping device oriented vertically;

FIG. 9 is a more detailed enlarged view of the FIG. 7 device in a section view taken perpendicularly to the axis of the traction drum; and FIG. 10 a section through the axis of the traction drum of FIG. 9.

DESCRIPTION OF THE PREFERRED EMBODIMENTS

Figure 5:
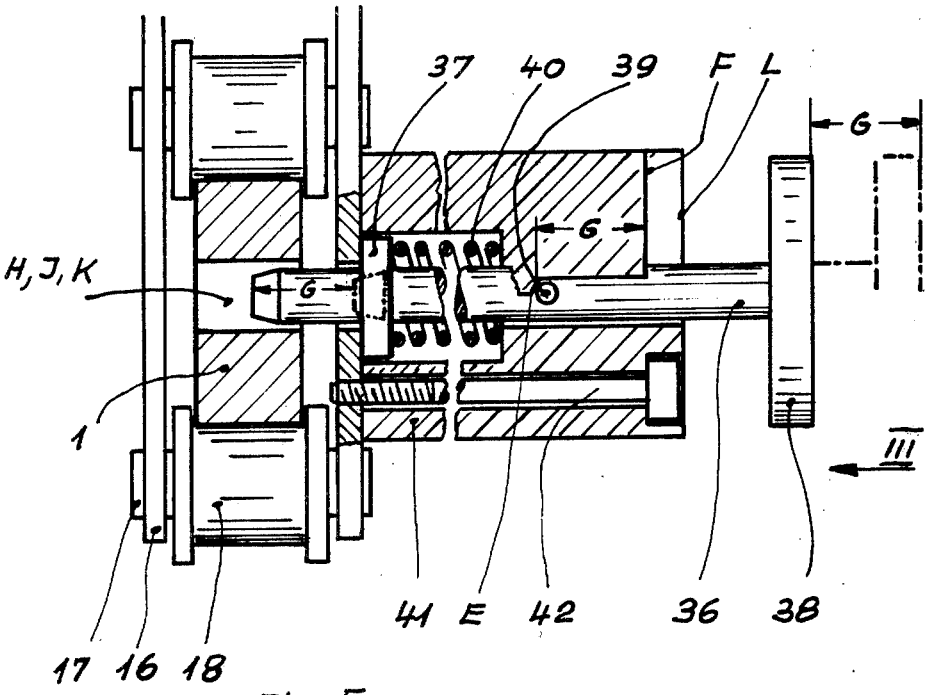
FIG. 5 a partial section in enlarged representation through the tackle block according to the line I—I of FIG. 1.
Figure 6:
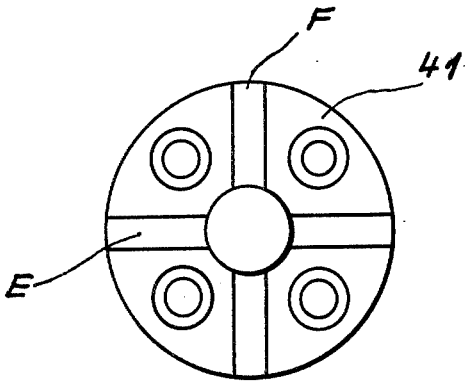
FIG. 6 view in the direction of the arrow III on part 41 of FIG. 5.

The swivel mechanism displayed in the figures consists of a circularly bent roll bracket 1 provided with stops 2 and 3 which is firmly connected with a bushing 4 for the incorporation of a clamping device 15. On the bushing 4 is provided the handle 5 for moving and swiveling the clamping device 15. The latter is, as can be seen in FIG. 3, movably guided in the bushing 4 with a shifting element 11 and connected by way of a laterally projecting plate 9 with a threaded spindle 6 which is pivoted in the plate 9 and axially secured against it by setting rings 10. The spindle 6 enters with its lower end into a spindle box 7 mounted on the bushing 4 and can be turned by means of a handwheel 8.

The clamping device is in the present example of an execution constructed as an internal gripping device for paper webs. It consists of a receiving mandrel 15 constructed as an expanding mandrel which is tightened against the inner wall of the winding core 35 of this paper web 34 in the usual manner. The receiving mandrel 15 is moreover firmly connected with the shifting element 11 concentric to the mandrel by means of a yoke 13 and provided with a flange 14 which, when the mandrel 15 is introduced into the roll of paper 34, lies against the front side of the winding core 35.

The roll bracket 1 is guided shiftable between rollers 18 and 19 which are pivoted in a known manner by means of bearing pins 17 and 20 in a tackle block 16 and axially secured. The tackle block 16 has on its upper end a hook bolt 21 into which is hooked a hook 22 hanging on a chain 23.

On the tackle block 16 is unilaterally fastened by screws 42 a spring sleeve 41 is accommondated axially movable a locking bolt 36. The locking bolt 36 has a spring clip 37, a handle 38 and carries a drop-in pin 39. In the spring sleeve 41 is also located a compression spring 40. Opposite the drop-in pin 36 are provided in the roll bracket a number of stops which in the displayed example of an execution are constructed as holes, three of which, H, J and K, are indicated. From FIG. 2 it becomes evident that the tackle block can be bolted in the stop hole H in such a way that the natural center of gravity of the moving accessory $S_2$ comes to lie vertically below the stop hole H and the receiving mandrel 15 stands thus in the horizontal. Other stops K, J are provided for the same purpose in the case of a different axial position of the receiving mandrel 15.

The receiving mandrel 15 is oriented to the roll bracket 1 in such a way that its axis runs through the center of the roll-bracket arch. Furthermore the receiving mandrel 15 is arranged on the shifting element 11 to be movable and adjustable against the roll bracket 1 in such a way that also in the case of loading paper webs 34 of different sizes the common center of gravity $S_1$ can by the proper operation of the spindle drive 6 to 10 always be brought into the approximate center of the roll-bracket arch.

In the case of an empty or unburdened device, when therefore the web lies on a support and the receiving mandrel 15 is in the cardboard winding tube or ferrule; in the vertical position the stop 3 insures that the mandrel axis is vertical and, in horizontal position, engagement of the detents, parts 36 to 41, with one of the stop holes H,J,K. The mandrel can thus always be easily introduced and withdrawn.

In the example of execution shown in FIGS. 3 and 4 the roll bracket 1 is arranged in the tackle block 16 movable by means of an auxiliary drive. For this purpose a roller chain 24 is provided on the roll bracket which on the end facing the bushing 4 is fastened by a fixed support 25 and on the opposite end by a tightening clamp 26. The roller chain 24 is moreover fastened in a known, and therefore not shown manner at certain intervals on the flange of the roll bracket 1. The roller chain 24 is engaged by a sprocket wheel 27 which is firmly connected with a drive shaft 28 firmly held in tackle block 16. This shaft 28 is driven by a brake motor 33 by means of a gearing 29. The tackle block 16 hangs in the present example on the hook 22 of an arm 30 which is for instance vertically adjustable guided on a fork lift.

This auxiliary drive serves for the purpose of aligning the receiving mandrel 15 independently of the position of the over-all center of gravity of the moving parts of the swiveling mechanism always with the axis of the deposited roll of paper. For the purpose a marking 31 is provided on the tackle-block plate 16 which has to be aligned with a corresponding marking 32 on the roll bracket 1 in order to obtain the horizontal position of the receiving mandrel 15.

The mode of operation of the apparatus displayed in FIGS. 1 and 2 is the following: If a paper web roll or other object deposited on the front side has to be turned over into a different position, the roll bracket 1 has to be shifted in the tackle block 16 up to the stop 3. The receiving mandrel 15 is then introduced into the winding sleeve 35 of the paper roll 34 by lowering the chain 23 and by means of a not displayed expanding mechanism tightened against the inner wall of the winding sleeve 35. The entire apparatus with the clamped paper web is then lifted until the bottom clearance sufficient for the swiveling operation is reached. The handle 5 which at this point is in the position A is pulled now in the direction of the arrow B until the handle 5 has reached the position C shown in FIG. 2. The roll 34 turned into the horizontal position can now be deposited on an appropriate support. The crane hook 22 is then lowered even further until the detent mounted on the tackle block 16 with the locking bolt 36 comes to be positioned over the desired stop location H to I. The drop-in pin 39 was resting during this motion on the surface F of the spring sleeve 41, so that the drop-in bolt 36 was drawn toward the right to the extent G in FIG. 5. Over the desired stop location the handle 38 is pulled counter to the direction of the arrow III in order that the drop-in pin 39 turned over the surface L by 90° can slide into the notch E. The point of the locking bolt 36 rests then in the desired detention hole H,J,K. The motion in the direction of the arrow III is limited by the stop of the spring clip 37 on the tackle block 16. The expanding mandrel 15 is now relaxed and withdrawn from the winding core by the handle 5.

If rolls of other dimensions are to be turned over, the receiving mandrel 15 has to be moved downward prior to the insertion by rotating the hand wheel 8 over the spindle 6 and the shifting element 11 to such an extent that the smaller weight of the shorter roll is tared in such a way that the common center of gravity of the roll and the parts of the swivel mechanism moving together with it lies again in the axis passing through the center of the roll radius. Since the receiving mandrel 15 has to be adjusted to an empirically determined position for each specific roll size, a scale 12 is arranged on the shifting element 11 for facilitating this adjustment. The turning-over of a horizontally deposited paper web into a vertical position is carried out in exactly inverted sequence.

In the example of an execution displayed in FIG. 3 the aligning of the receiving mandrel 15 to the horizontal or vertical position takes place by the operation of a brake motor 33. In order to bring the receiving mandrel 15 with the apparatus having been unloaded into the horizontal position, the two markings 31 and 32 have in the upper extreme position of the receiving mandrel, thus with spindle 6 completely withdrawn, to be superposed. Analogously to the stop locations indicated in the example of an embodiment according to FIGS. 1, 2, 5 and 6 other markings can also be applied to the bracket 1 of the FIG. 4 corresponding to the scale position 12. The turning of the paper web 34 is also done by the operation of the auxiliary drive 29, 33. Since the common center of gravity of the paper roll and the moving parts of the swivel mechanism moved along can also here be directed toward the center of the roll bracket 1, the force to be applied by the brake motor 33 for turning over the roll of paper is very small.

Referring now to FIGS. 7–10, there is shown an embodiment including a traction drum which enables adjustment by hand of the empty device. A tackle block 16 is attached by means of a lug 21 on a chain 23 which is guided in a suspension point M. The chain 23 itself can be run over a tackle or a winch, which is not displayed in detail.

On tackle block 16 are supported on bearing pins 17 and 20 (FIG. 9) rollers 18 and 19 over which is guided a roll bracket 1 in the shape of a circular segment, so that it can be moved on a circular arc over the rollers 18 and 19. On one end of the roll bracket 1 sits a bushing 4 (FIGS. 7 and 8) in which by means of a crank handle 8 a sliding element 11 is guided. On the front end of the sliding part 11 rests a yoke 13 which carries a receiving mandrel 15 with a clamping device, not shown in the drawing. The receiving mandrel 15 can be introduced into the inner sleeve of a roll of paper 34 (shown in part in dot-dash outline in FIG. 7) or of another roll and tightly fastened therein. The apparatus as described is laid out in such a way that with the paper web held tightly the center of gravity of the roll bracket 1 with the receiving mandrel 15 and the paper roll 34 lies, therefore with the full load on the apparatus, on the center of curvature of the roll bracket 1. This means that the center of gravity aligns itself perpendicularly underneath the suspension point. The roll bracket 1 can consequently be manually operated with the apparatus under load because the center of gravity of the load remains at the same level, so that no lifting energy has to be applied for turning the roll bracket 1.

The apparatus without load is with regard to the suspension point not weight-unburdened because the gravitational center of the empty roll bracket and the empty receiving mandrel does not correspond to the curve center of the roll bracket. In the case of horizontal orientation of the axis of the receiving mandrel 15 according to FIG. 7, the apparatus assumes the position shown relative to the suspension point M. The center of gravity S is not to be found underneath the lug 21. FIG. 8 shows the position of the center of gravity S and of the lug 21 with reference to the vertical orientation of the axis of the receiving mandrel 15.

In order to achieve weight-unburdening, the invention provides a traction drum 51 which is pivoted on a bolt 52 (FIGS. 9 and 10). The bolt 52 is for its part pivoted in the side walls of the roll plate 16. Bolt 52 has an axial slot 53. On the inside of the wall of traction drum 51 a slot 54 is likewise provided. Into the slots 53 and 54 are hooked the bent-off ends of a coil spring which prestresses traction drum 51 clockwise with reference to FIG. 9. On the peripheral area of traction drum 51 a traction cable 56 is wound up. Cable 56 is guided over a load roller 57 and hooked into a lug-shaped holding fixture 58 of the bushing 4 of the clamping device.

On a front end of bolt 52 is mounted a worm wheel 59 into which meshes a worm gear 60. The worm gear 60 has a handle, not shown, such as an adjusting lever or a crank grip. By means of worm gear 60 the worm wheel 59 can be turned, whereby the prestress of the coil spring 55 and thus the magnitude of the relieving tension can be adjusted. Worm gear 60 has self-locking properties, so that the relieving tension, once set, does not accidentally get out of adjustment. The prestress of the coil spring 55 is so adjusted that the weight of the unburdened clamping device is balanced for a horizontal orientation of the receiving mandrel 15. The clamping device can in this way easily be turned upright because the weight of the clamping device is unburdened by the traction rope 56.

For the weight unburdening in vertical orientation of the receiving mandrel 15 according to FIG. 8, a stop slide 62 is provided guided in a bushing 61 held on the tackle block 16, which slide is prestressed by a compression spring 63. An adjusting plate 64 with an adjusting spindle 65 makes setting of the prestress of the compression spring 63 possible. The compression spring 63 is so adjusted that the receiving mandrel 15 stands vertically in unburdened condition. With the reception of the load the tackle block moves then toward the bushing 4, so that the spring is correspondingly compressed.

A flat-running characteristic of the tightening drum 51 is particularly suitable, so that the traction cable 56 can be rolled in all the way up to the vertical orientation of the receiving mandrel 15.

The invention is not limited to the examples of embodiments given here. Thus can for instance the scale 12 be fastened to the shifting element 11 in the examples of execution according to FIG. 1 and 2 just as well as it can be mounted in the area of the stop locations I to K and in the examples according to FIGS. 3 and 4 from the marking 32 in the direction toward the stop 2.

I claim:

1. Apparatus for positioning an object, comprising a swivel mechanism having:

guidance means;

a circularly bent roll bracket movably mounted on said guidance means for movement relative thereto about the center of curvature of said roll bracket;

a clamping device adapted to receive an object to be positioned; and means shiftably mounting said clamping device on said roll bracket, whereby said clamping device, and thereby the associated object received thereon, is shiftable with respect to said roll bracket so that the common center of gravity of said swivel mechanism and the associated object to be positioned can be shifted, to an extent depending on the size and shape of the associated object, to coincide with the center of curvature of said roll bracket.

2. The apparatus of claim 1, wherein said means shiftably mounting said clamping device on said roll bracket comprises a bushing on said roll bracket, a shifting element shiftably received within said bushing and a yoke connecting said clamping element to said shifting element.

3. The apparatus of claim 2 wherein said clamping device is an axially extending mandrel adapted to be introduced into a tube-shaped aperture having its axis disposed parallel to and offset from the direction of movement of said shifting element, and oriented to pass through approximately the center of curvature of said roll bracket.

4. The apparatus of claim 3 further including a spindle drive mounted on said roll bracket to shift said shifting element relative to said roll bracket.

5. The apparatus of claim 2 wherein said shifting element has scale indicia thereon to indicate the proper position of said shifting element relative to said roll bracket for various sizes and shapes of the associated object to be positioned.

6. The apparatus of claim 3 wherein said roll bracket has a stop thereon positioned to retain said roll bracket in a position relative to said guidance means to dispose said mandrel in a vertical position.

7. The apparatus of claim 2 further including locking means to lock said roll bracket in one of selected positions relative to said guidance means to maintain said mandrel in a horizontal orientation, said one position being determined by the shifted position of said mandrel.

8. The apparatus of claim 1 further including auxiliary drive means to move said roll bracket relative to said guide means.

9. The apparatus of claim 1 further including means to weight—unburden said clamping device when the associated object is removed therefrom, said means to weight—unburden comprising a prestressed traction drum on which is wound a traction cable attached to a holding fixture mounted on said clamping device.

10. The apparatus of claim 9, in which said traction cable is guided from said traction drum over a load roller.

11. The apparatus of claim 9, in which said traction drum is rotatably mounted on a bolt and is prestressed by a coil spring attached to said bolt and to said drum, and said bolt is rotatably settable by means of a setting device to adjust the prestress.

12. The apparatus of claim 11, in which a worm wheel is mounted on said bolt and a worm gear having a handle meshes with said worm wheel.

13. The apparatus of claim 9, in which said coil spring has a flat characteristic.

14. The apparatus of claim 9, further including a tackle block to receive said bolt and traction drum, said traction box further receiving a bushing, and a spring-loaded stop slide which supports a holding fixture in the vertical position.

15. The apparatus of claim 9, further including a bushing within which a compression spring is arranged, one end of which bears against a stop slide and the other end of which bears against an adjusting plate.

16. The apparatus of claim 1 wherein said guidance means further comprises a tackle block.

* * * * *